United States Patent [19]

Fleissner

[11] 3,965,511

[45] June 29, 1976

[54] PROCESS FOR CONTINUOUS HEAT-SETTING AND SHRINKING OF SYNTHETIC FIBERS

[75] Inventor: Heinz Fleissner, Egelsbach near Frankfurt am Main, Germany

[73] Assignee: Vepa AG, Switzerland

[22] Filed: Apr. 11, 1973

[21] Appl. No.: 350,090

[30] Foreign Application Priority Data

Apr. 14, 1972 Germany ..... 2218035

[52] U.S. Cl. ..... 8/149.1; 8/149.3; 68/DIG. 5; 28/72.14

[51] Int. Cl.[2] ..... D06B 3/04; D06B 3/02; D06B 21/00

[58] Field of Search ..... 8/149.1, 149.3, 151.2; 68/5 D, 5 E, DIG. 5, 19.1, 20; 28/72.14; 34/37

[56] References Cited

UNITED STATES PATENTS

| | | | |
|---|---|---|---|
| 3,041,863 | 7/1962 | Goto | 68/5 E |
| 3,242,702 | 3/1966 | Fleissner | 68/5 E |
| 3,326,022 | 6/1967 | Drago | 68/5 D |
| 3,730,679 | 5/1973 | Schuierer | 68/20 X |
| 3,750,428 | 8/1973 | Bruckner | 68/19.1 X |

*Primary Examiner*—Peter Feldman
*Assistant Examiner*—Philip R. Coe
*Attorney, Agent, or Firm*—Craig & Antonelli

[57] ABSTRACT

A process for the continuous heat-setting and shrinking of synthetic fibers in the form of yarns with a given twist and/or in the form of tows with a forced crimp by means of a heated fluid medium with temperatures between 100° and 220°C, characterized in that the fibers are treated in a two-step continuous process, first at temperatures below 100°C in water or saturated steam temperatures, or slightly superheated steam, respectively, and subsequently with air, superheated steam or a superheated steam-air mixture at high temperature conditions between 150° and 220° C.

14 Claims, 3 Drawing Figures

PROCESS FOR CONTINUOUS HEAT-SETTING AND SHRINKING OF SYNTHETIC FIBERS

DESCRIPTION OF THE INVENTION

This invention relates to a process for continuous setting and shrinking of synthetic fibers, for instance, yarn with a given twist and/or in the form of tows with a forced crimp, with a medium heated to temperatures of between 100° and 220°C.

In order to set the forced crimp or twist of, for instance, carpet yarn, the synthetic fibers in the form of tows or yarns have to be treated in an atmosphere and temperature compatible with the respective fiber. Aside from the setting of fibers, the possibility of balancing the shrinking capacity of the fibers must be assured. The degree of shrinkage thus obtained has to be near that of shrinkage in the boil in order to avoid unpleasant changes in clothing measurements after subsequent washing. To this day, this heat treatment is done on discontinuously working autoclaves, which distinguish themselves in that it is possible to work inside of them, wet, under vacuum and then over pressure at temperatures above 100°C.

Both conditions, namely, the setting and shrinking of fibers, may be best obtained by means of moist gas, i.e., in an atmosphere of saturated steam. However, this is not done at a normal temperature and a normal pressure, but rather in an atmosphere free from air, and then raised pressure, i.e. air is first evacuated from the autoclave and then steam is introduced under pressure, so that a temperature of between 120° and 135°C is achieved. In this moist atmosphere, the fiber shrinks, and twist or crimp are set by the high temperatures, or vice versa.

However, the result of this treatment is not achieved throughout the autoclave all at the same time. It is, therefore, brought up to the temperature and pressure 3 to 5 times, by automatic control, and relaxed to normal pressure for balancing in between, so that the steam can penetrate all of the fibers, and the temperature is distributed evenly throughout after completion of the treatment. An exactly even temperature throughout the cross-section of the mass of yarn or tow is necessary because variations as slight as $\pm$0.5°C have a negative effect on the dye affinity. A further condition for uniform dye affinity is the moisture during the setting and shrinking process. It has to be at least 4% by weight, possibly more. Of course, the best and most uniform conditions are given with a hot water treatment; however, a saturated steam atmosphere will also give satisfactory results.

It has also been attempted to carry out the shrinking and setting of fibers in a continuous process. Steamers have been developed, in which saturated steam at 130°C can be produced. However, they serve to heat-set woven fabrics. These steamers have to have sealing rollers at the intake and discharge ends, which exert considerable pressure on the material. This has hardly a negative effect on woven fabrics. With yarns and tows, however, it eliminates the twist or crimp prior to the setting, at least partially, so that those machines cannot be used for this purpose.

It has furthermore been attempted to carry out the setting of the twist or crimp instead of saturated steam with hot air or overheated steam at about 170°C. However, satisfactory results could only be noted after several minutes of dwell time. The only satisfactory aspect of this procedure with polyamide fibers were the residual shrinking values. The setting of the crimp did not come up to the quality achieved by the discontinuous process.

The invention aims at developing a procedure by which the discontinuous treatment for shrinking and setting of synthetic fibers is replaced by an equivalent continuous procedure.

Sufficient shrinking and setting data have been achieved with the procedure of this invention by treating the fibers in a twostep procedure, i.e., first at temperatures of just below 100°C in water, or at temperatures of saturated steam (i.e., about 95° to about 99°C), or with slightly superheated steam (at about 103° to 110°C), respectively, and subsequently, with air, superheated steam or superheated steam/air mixtures at temperatures between 150°C and 220°C.

Depending upon the kind of fiber, satisfactory shrinking and setting data were achieved in continuous execution of this treatment. With polyamide fibers, it was possible to set the crimp and/or twist of the fiber by means of hot water or saturated steam, while the fiber was subsequently allowed to shrink freely under high temperature conditions. Polyacrylic fibers, however, first shrank to the desired degree in hot water or saturated steam. The crimp and/or twist was subsequently set at high temperature.

Now, as ever, saturated steam conditions a few degrees above 100°C are favorable. With advantage, these may be achieved in a continuous process without the disadvantages mentioned, if the setting of the forced crimp is done right in the crimping chamber by injecting steam into the chamber under overpressure conditions, i.e., at a pressure of from about 2 to 6 atmospheres. Since the chamber is closed all around, and the fiber package itself closes off the discharge end, increased pressure in the chamber with temperatures of about 120° to 130°C. can arise by means of this saturated steam.

In case it is not possible to set the fibers inside the crimping chamber due to the construction of the crimper proper, the crimped tow may be run into a steamer directly following the crimper, in which it should be placed on a perforated drum or mesh belt, without tension.

It is beneficial to use the flow-through principle of a sieve drum device as this assures an even and quick treatment over the cross-section of the fiber package, and the temperature distribution inside the steamer housing is even. The shrinking of polyamide fibers under high temperature conditions should also be done in a sieve drum device of high-temperature design. The same goes for the setting of polyacrylic fibers.

Should for any reason the fibers delivered for shrinking and setting be wet, the fibers may have been washed or sprayed with some solution and it is advisable to get rid of the excess moisture first, preferably on a sieve drum device, before running the fibers into a steamer and then into the high-temperature version of a sieve drum device for complete drying.

DESCRIPTION OF THE DRAWINGS

In the drawings, preferred embodiments of the apparatus for effecting the described treatment are shown wherein.

Figure 1:
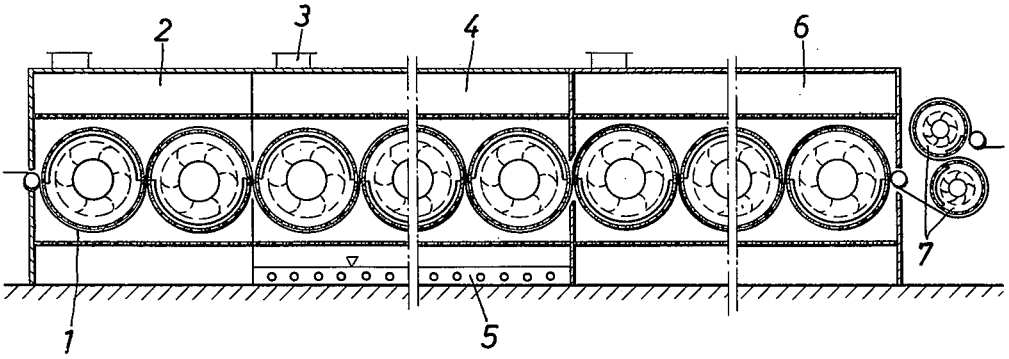
FIG. 1 shows a section through a multi-drum sieve drum device with three treatment compartments.

The embodiment of the apparatus according to FIG. 1 is advisable if the delivered tow or yarn 1 has too high a moisture content for the heat treatment. It is, therefore, warmed up and predried in compartment 2 by the suction draft of a sieve drum steamer or a mesh belt steamer. A water sump 5 on the bottom is provided for the saturated steam production; however, the steam may also be injected from an outside source.

The steaming chamber 4 has an air discharge duct 3 so that this chamber may also be used as a dryer, if need be. After the steam treatment, the tow is automatically forwarded into the sieve drum dryer 6, which is designed for high-temperature operation and where temperatures between 170° and 220°C prevail by drawing a heated gas, i.e., a superheated steam, or mixtures thereof, therethrough. The tow or yarn may be plaited on the drums or is overfed in running direction. Finally, the material is run over a cooling, device 7 in the form of a pair of rolls for quick cooling in order to prevent color changes of the fiber and brittleness. The individual units 2, 4 and 6 may also be installed separately from each other.

Figure 2:
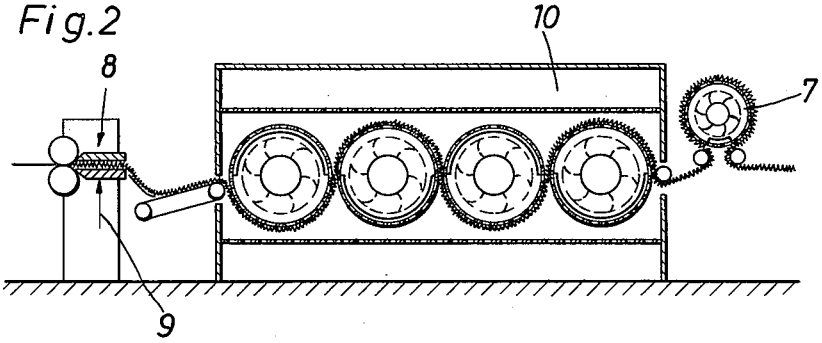
FIG. 2 shows a compression chamber crimping device with directly following sieve device, also shown in section.

In the embodiment of the apparatus according to FIG. 2, the setting of polyamide fibers is done in the compression chamber of crimping device 8 by injecting saturated steam under overpressure, i.e., from about 2 to about 6 atmospheres, into the completely enclosed chamber, directly after a pair of intake rollers, in direction of arrow 9. Temperatures are advantageously between about 130° and 140°C for the polyamide fibers. Saturated steam conditions may develop in this chamber, as the outgoing end is blocked by the fiber mass itself. This makes it possible to run the set crimped tows directly into a drum dryer 10, in which merely the necessary shrinkage is produced. At the outgoing end, another cooling device 7 in the form of a sieve drum is provided.

Figure 3:
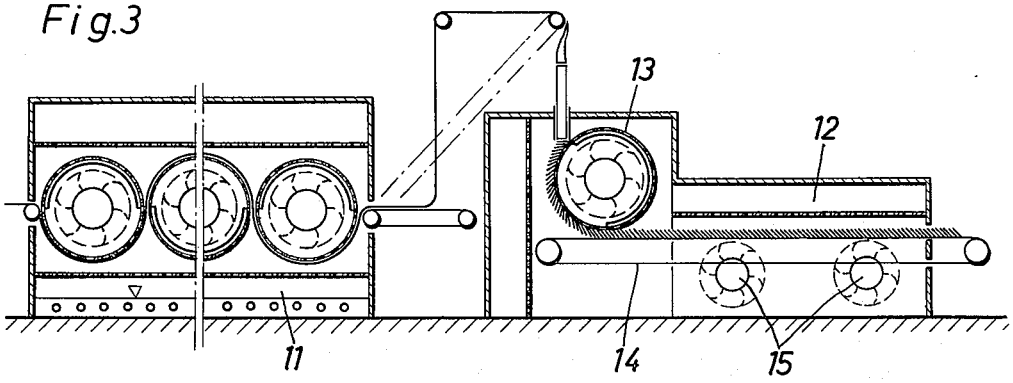
FIG. 3 illustrates the combination of a sieve drum steamer with setter, consisting of a heating drum with subsequent endless conveyor belt.

The embodiment of the apparatus according to FIG. 3, employs a sieve drum steamer 11, followed by a machine 12, in which the tow is treated in a technologically favorable condition, and a long dwell time is achieved in a short machine length. As can be seen from the drawing, in the machine 12, the tow is parallel to the drum axis 12 at a width corresponding to the drum width, and essentially radially on the drum jacket. The tow package is then transferred from the perforated drum 13 to the endless conveyor belt 14, which extends horizontally and tangentially below the drum 13. On this belt, also, the material is penetrated by a gaseous medium, which medium flow is produced by the fans 15.

This special tow arrangement on the transporting surface prevents the setting of creases at the points where the tow plaits reverse, and permits an even heating over the length of the tow.

It will be appreciated that the steam temperature used for crimping is dependent on the steam pressure and selected to suit the fibers being treated; e.g. for polyacrylic fibers, a temperature of only between about 105° and 110°C. is sufficient.

While novel embodiments of the invention have been described, it will be understood that various omissions, modifications and changes in these embodiments may be made by one skilled in the art without departing from the spirit and scope of the invention.

What is claimed is:

1. A process for continuous heat-setting and shrinking of synthetic fibers in the form of yarns with a twist and synthetic fibers in the form of tows with a forced crimp by a heated fluid medium, characterized in that the synthetic fibers in at least one of said forms, in a two-step continuous procedure, are treated initially in a heated fluid medium selected from the group consisting of hot water at temperatures just below 100°C., saturated steam, and slightly superheated steam, and the synthetic fibers are immediately thereafter treated in a second heated fluid medium selected from the group consisting of air, superheated steam, and a superheated steam-air mixture at high temperature conditions between 150°C. and 250°C.

2. A process according to claim 1 for the heat-setting and shrinking of polyamide fibers and those synthetic fibers with similar heat-setting and shrinking behavior, characterized in that the synthetic fibers are first set in said saturated steam, and treated immediately thereafter under said high temperature conditions to effect complete shrinkage.

3. A process according to claim 1 for the heat-setting and shrinking of polyacrylic fibers and those synthetic fibers with similar heat-setting and shrinking behavior, characterized in that the synthetic fibers are first shrunk in saturated steam, and treated immediately thereafter under said high temperature conditions to effect setting.

4. A process according to claim 1, characterized in that said synthetic fibers are fibers which contain moisture and said synthetic fibers are pre-dried before said twostage procedure and the fibers are then steamed to effect setting with said first heated fluid medium and finally the synthetic fibers are shrunk completely and dried in a dryer under said high temperature conditions.

5. A process according to claim 1, characterized in that at least one of the individual procedures is carried out by means for treating said synthetic fibers by passing a heated fluid medium therethrough while said synthetic fibers are supported against the medium flow.

6. A process according to claim 1, characterized in that a saturated steam is at a temperature from about 95°C. to about 99°C. and the slightly superheated steam is at a temperature of from 103°C. to 110°C.

7. A process according to claim 1, characterized in that at least one of the heated fluid mediums is drawn through the synthetic fibers by conveying the synthetic fibers on the surface of at least one sieve drum means subjected to a suction draft.

8. A process according to claim 1, characterized in that the first heated fluid medium is saturated steam and both the first and second fluid heated mediums are drawn through the synthetic fibers by conveying the synthetic fibers on a surface of at least one sieve drum means subjected to a suction draft within a housing containing one of the heated fluid mediums.

9. A process according to claim 1, further comprising pre-drying of synthetic fibers which contain moisture therein before said two-stage treatment procedure and the synthetic fibers are then steamed to effect shrinking of said fibers by said first heated fluid medium and the synthetic fibers are finally set and dried in a dryer under said high temperature conditions.

10. The process according to claim 1, characterized in that the first heated fluid medium is said hot water.

11. The process according to claim 1, characterized in that the first heated fluid medium is said saturated steam.

12. The process according to claim 1, characterized in that the first heated fluid medium is said slightly superheated steam.

13. A process according to claim 1 for the heat-setting and shrinking of polyamide fibers and those synthetic fibers with similar heat-setting and shrinking behavior, characterized in that the synthetic fibers are first set in said hot water and treated immediately thereafter under said high temperature conditions to effect complete shrinkage.

14. A process according to claim 1 for the heat-setting and shrinking of polyacrylic fibers and those synthetic fibers with similar heat-setting and shrinking behavior, characterized in that the synthetic fibers are first shrunk in said hot water and then treated immediately thereafter under said high temperature conditions to effect setting.

* * * * *